US010745191B2

(12) United States Patent
Cox

(10) Patent No.: US 10,745,191 B2
(45) Date of Patent: Aug. 18, 2020

(54) BAFFLED FLUID CONTAINER ASSEMBLY

(71) Applicant: Clay Cox, Midland, TX (US)

(72) Inventor: Clay Cox, Midland, TX (US)

( * ) Notice: Subject to any disclaimer, the term of this patent is extended or adjusted under 35 U.S.C. 154(b) by 0 days.

(21) Appl. No.: 15/951,569

(22) Filed: Apr. 12, 2018

(65) Prior Publication Data

US 2019/0002195 A1 Jan. 3, 2019

Related U.S. Application Data

(60) Provisional application No. 62/524,775, filed on Jun. 26, 2017, provisional application No. 62/487,572, filed on Apr. 20, 2017.

(51) Int. Cl.

| | |
|---|---|
| ***B65D 88/12*** | (2006.01) |
| ***B65D 90/24*** | (2006.01) |
| ***B65D 90/48*** | (2006.01) |
| ***B65D 90/00*** | (2006.01) |
| ***B65D 90/34*** | (2006.01) |

(52) U.S. Cl.

CPC ..... *B65D 88/128* (2013.01); *B65D 90/0033* (2013.01); *B65D 90/24* (2013.01); *B65D 90/34* (2013.01); *B65D 90/48* (2013.01)

(58) Field of Classification Search

CPC .. B65D 88/128; B65D 90/0033; B65D 90/24; B65D 90/34; B65D 90/48

USPC ..... 222/399, 400.7–400.8, 401, 464.7

See application file for complete search history.

(56) References Cited

U.S. PATENT DOCUMENTS

| | | | | | |
|---|---|---|---|---|---|
| 3,626,476 | A * | 12/1971 | Trumble | F24C 5/20 | 141/329 |
| 3,912,103 | A * | 10/1975 | Gerhard | B60P 3/221 | 220/1.5 |
| 4,114,783 | A * | 9/1978 | Wempe | B65D 88/54 | 137/590 |
| 4,823,989 | A | 4/1989 | Nilsson | | |
| 5,291,746 | A * | 3/1994 | Abbott | B65F 1/02 | 414/420 |
| 5,353,967 | A | 10/1994 | Toth et al. | | |
| 5,381,923 | A * | 1/1995 | O'Dea | B65D 90/24 | 220/4.12 |
| 5,873,500 | A * | 2/1999 | Homburg | B67D 7/845 | 222/399 |
| 5,996,827 | A * | 12/1999 | Splane | B65D 88/128 | 220/1.5 |
| 6,012,598 | A * | 1/2000 | Antoniou | B65D 88/128 | 220/1.5 |
| 6,648,177 | B2 * | 11/2003 | Burger | B67D 7/845 | 222/108 |
| 7,275,651 | B2 * | 10/2007 | Morales | B65D 88/022 | 220/203.23 |
| 7,337,926 | B2 | 3/2008 | LeRoy | | |
| 7,856,998 | B2 * | 12/2010 | Bauer | B60P 3/14 | 137/15.16 |

(Continued)

*Primary Examiner* — Paul R Durand
*Assistant Examiner* — Andrew P Bainbridge
(74) *Attorney, Agent, or Firm* — Jackson Walker LLP

(57) ABSTRACT

A rectangular or square fluid container having a baffle assembly configured to fit inside an interior volume within the fluid container. The fluid container is capable of being pressurized and has a number of valves or ports on a top wall thereof, which valves or ports allow for the fluid container to be filled with a fluid, for the fluid container to be pressurized, and for the removal of fluid from the fluid container.

28 Claims, 26 Drawing Sheets

(56) References Cited

U.S. PATENT DOCUMENTS

| | | | | |
|---|---|---|---|---|
| 8,245,889 | B1 * | 8/2012 | Starns | B67D 7/0238 222/399 |
| 8,622,251 | B2 * | 1/2014 | Oren | B65G 65/23 222/185.1 |
| 8,702,853 | B2 * | 4/2014 | Hebblethwaite | B01D 53/1468 220/565 |
| 8,899,452 | B2 * | 12/2014 | Takanohashi | B65D 51/1683 137/212 |
| 9,051,118 | B2 * | 6/2015 | Jacobson | B65D 90/24 |
| 9,707,881 | B2 * | 7/2017 | Reynolds | B60P 3/2235 |
| 9,840,367 | B2 * | 12/2017 | Fitzgerald | B65D 90/24 |
| 2009/0045216 | A1 * | 2/2009 | Mamaghani | B67D 7/00 222/1 |
| 2011/0000813 | A1 * | 1/2011 | Dombkowski | A01M 17/002 206/524.5 |
| 2019/0002195 | A1 * | 1/2019 | Cox, I | B65D 88/128 |

* cited by examiner

Top side side 58
60
CCI

Top
58 side
58
60
bend side

26

26

F

26

26

BAFFLED FLUID CONTAINER ASSEMBLY

This utility application claims the benefit of priority of U.S. Application No. 62/487,572, filed Apr. 20, 2017; and Application No. 62/524,775, filed Jun. 26, 2017, and both of these applications are incorporated herein by reference.

FIELD OF THE INVENTION

A baffled fluid container.

BACKGROUND OF THE INVENTION

Fuel containers are used to transport and store fluids, including petroleum products and mine waste. They must be strong and substantially leak-free so as to isolate the contents from the environment. They must be capable of being easily filled and the contents must be easily removed. Typically, removal of the contents is done under the force of gravity with a drain valve located at or near the bottom of the container, with a fill valve or fill opening at or near the top. However, there are problems associated with such a configuration, including the potential for leak from the drain valve. Applicant's disclosure set forth herein addresses this and other problems with prior art fluid containers.

SUMMARY OF THE INVENTION

A fluid container comprising: a square or rectangular housing including six walls, the walls including a top wall, a bottom wall, and four side walls, the six walls may be full seam welded along complementary edges and define an interior volume. The rectangular housing has a length, width, and height, and a vertical axis. A baffle assembly may comprise four rectangular vertical walls, in some embodiments, oriented perpendicular to one another such that they bisect the inner volume into four portions, each vertical wall having side edges, a top edge and a bottom edge. The baffle assembly includes, in some embodiments, at least two open horizontal plates. In some embodiments, all of the vertical walls are welded to an inner surface of the side walls, and the top edges are welded through the surfaces of the top wall and to the bottom inner wall. Thus, the tank, in some embodiments, may be made leak proof—from leaking air or fluid.

In some embodiments, reinforcement allows the tank to be pressurized with a gas, such as air from the top wall, so as to remove fluid from the container from an outlet valve and inner draw tube, the outlet valve typically located on the top wall. With a fill valve or port on the top wall (and, optional, fluid level, tank pressure, and other gauges or ports), the container contents are controlled by top wall located elements for fill, pressurize, and drain operations.

In some embodiments, a fluid pump is provided to draw fluid out of the tank, so pressurization may not be needed. Typically, in some embodiments, the tank will be pressurized or may be provided with an electric or a hand pump for dispensing fluid from the tank. In some embodiments, the side walls and bottom walls are constructed to be leak proof for liquids, while the container is not necessarily leak proof for gases. For example, the container may have a vent in the top wall for venting the pump dispersion embodiments.

Applicant's fluid container, in some embodiments, comprises a square or rectangular housing having six steel walls; namely, a top wall, bottom wall, and four side walls into which fits a baffle assembly. The six steel walls define an interior volume. The housing has a length, width, and height and a vertical axis.

Inside, the baffle assembly, in some embodiments, comprises four vertical walls which are perpendicular to one another such that they divide the internal volume into substantially equal four portions. The baffle assembly may comprise one or a multiplicity of horizontal support plates. Some or all of the plates of the baffle are welded to each other (such as with a continuous seam weld) at the inner surface of the housing where they are in contact so as to strengthen the housing and make it airtight such that it can handle being pressurized. In some embodiments, the top wall may include some or all operational elements for fluid handling and measurement.

DETAILED DESCRIPTION OF THE PREFERRED EMBODIMENTS

Figure 1:
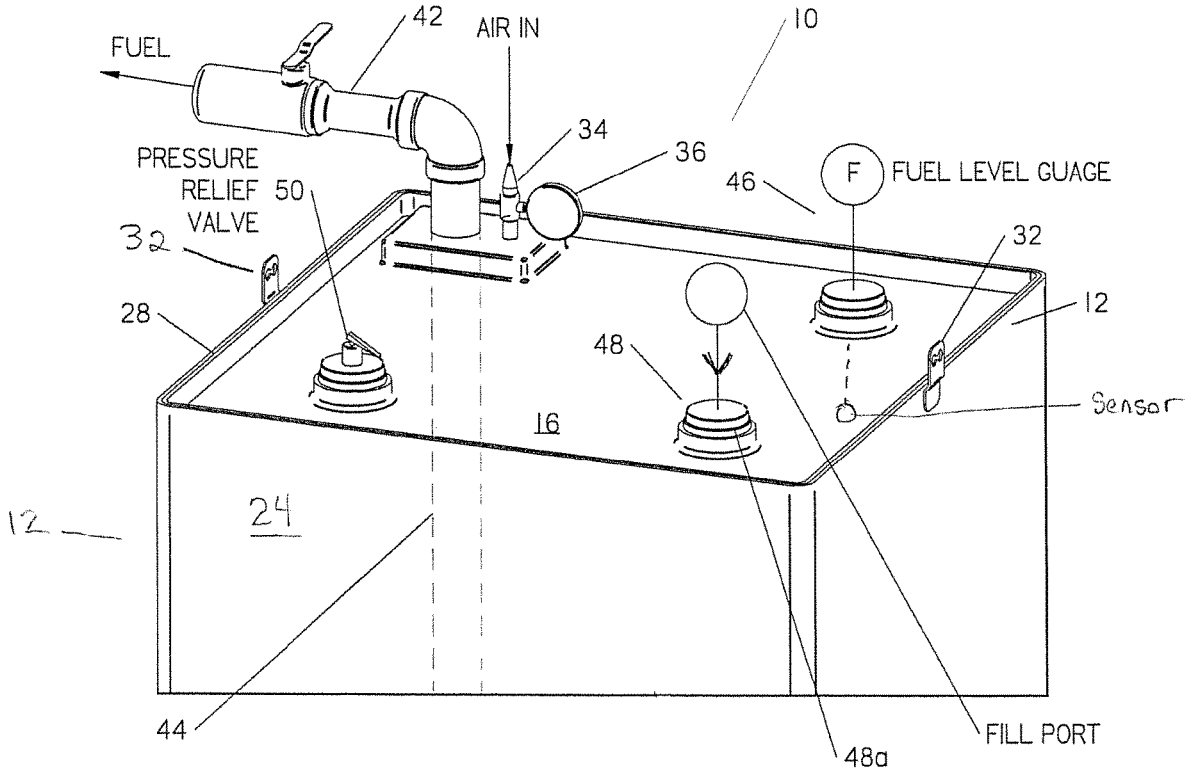
FIG. 1 is an external view of the fluid container, including a view of the top wall thereof and all the operational elements of the tank located thereon.
Figure 1A:
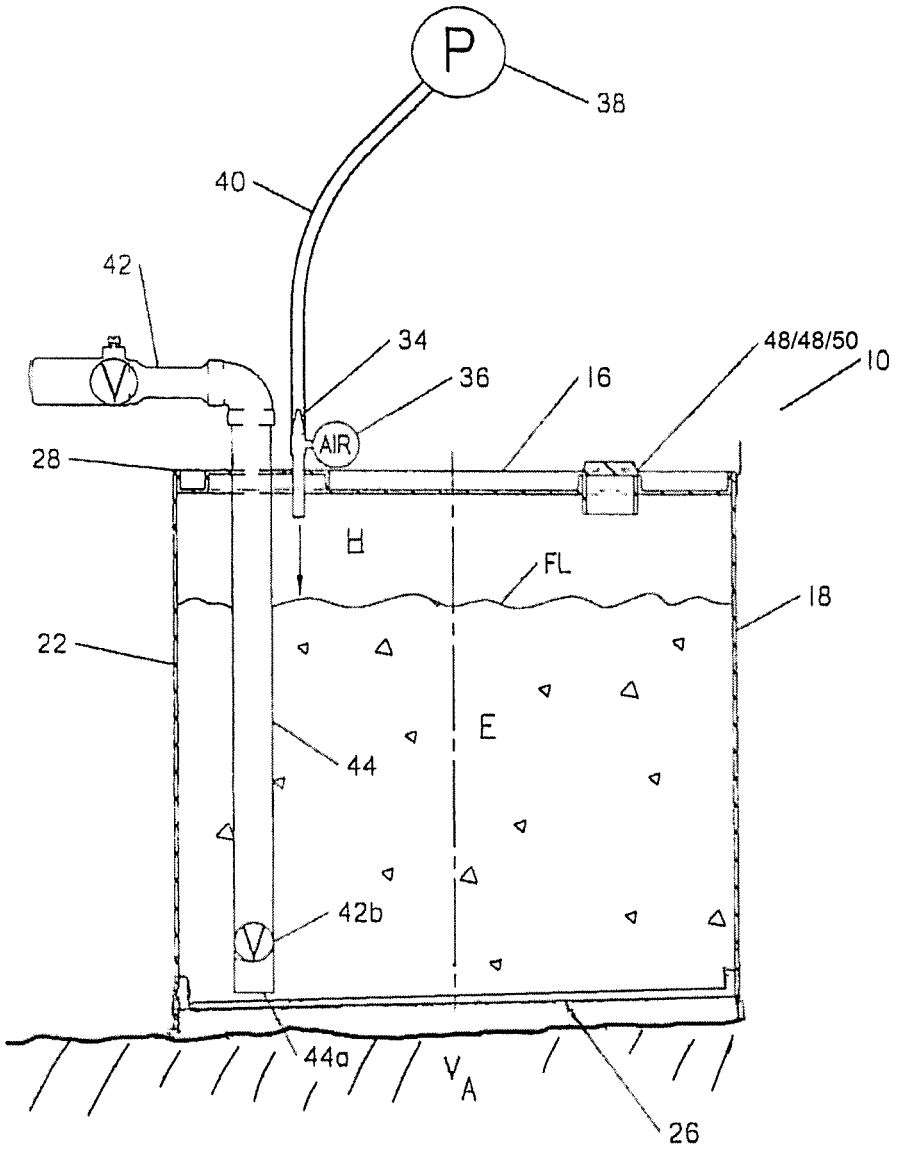
FIG. 1A is a cross-sectional view through an inner draw tube showing also the vertical axis, and internal fluid F having a fluid level FL and a head H.
Figure 1B:
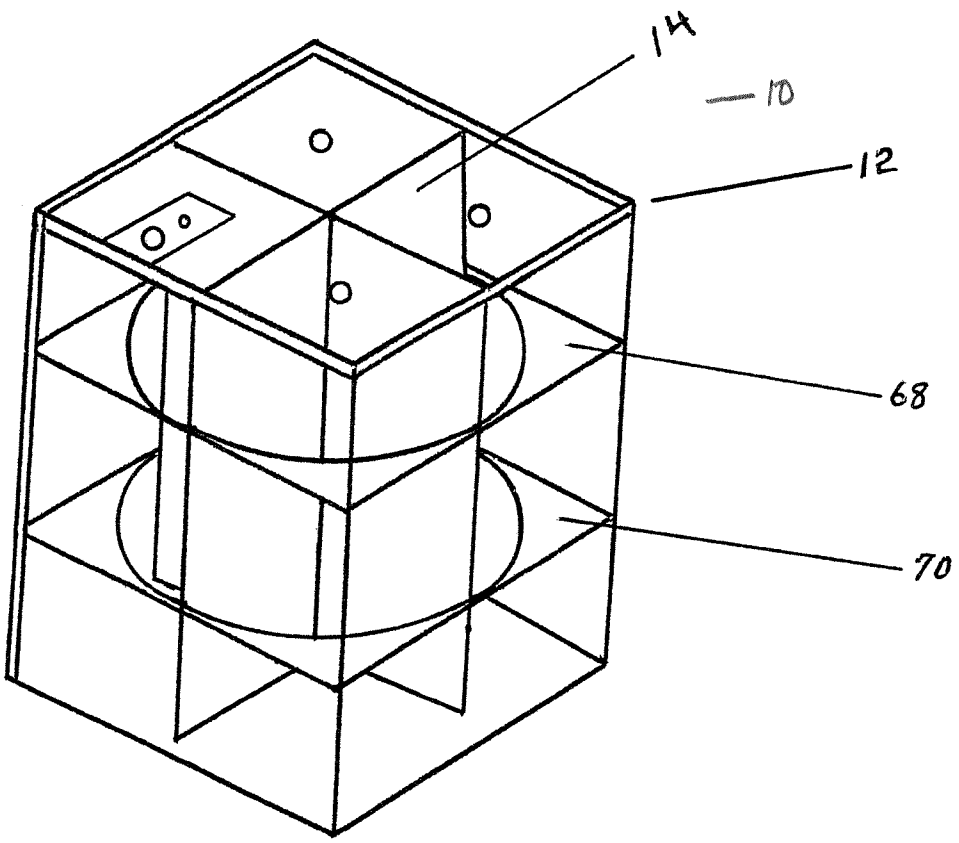
FIG. 1B is a three dimensional shaded transparent illustration of the fuel container.
Figure 2:
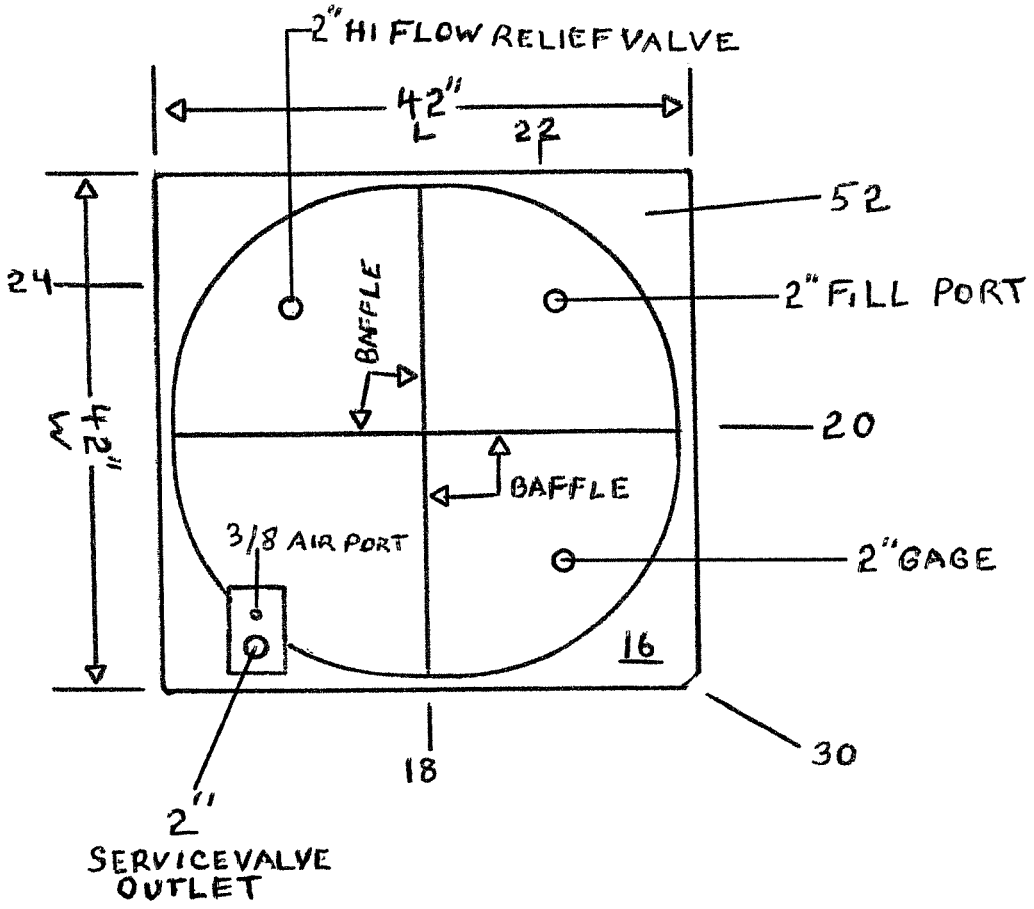
FIG. 2 is an external top view of the container showing the top wall and in ghosted lines, the baffle assembly that is located inside the housing of the container.
Figure 3:
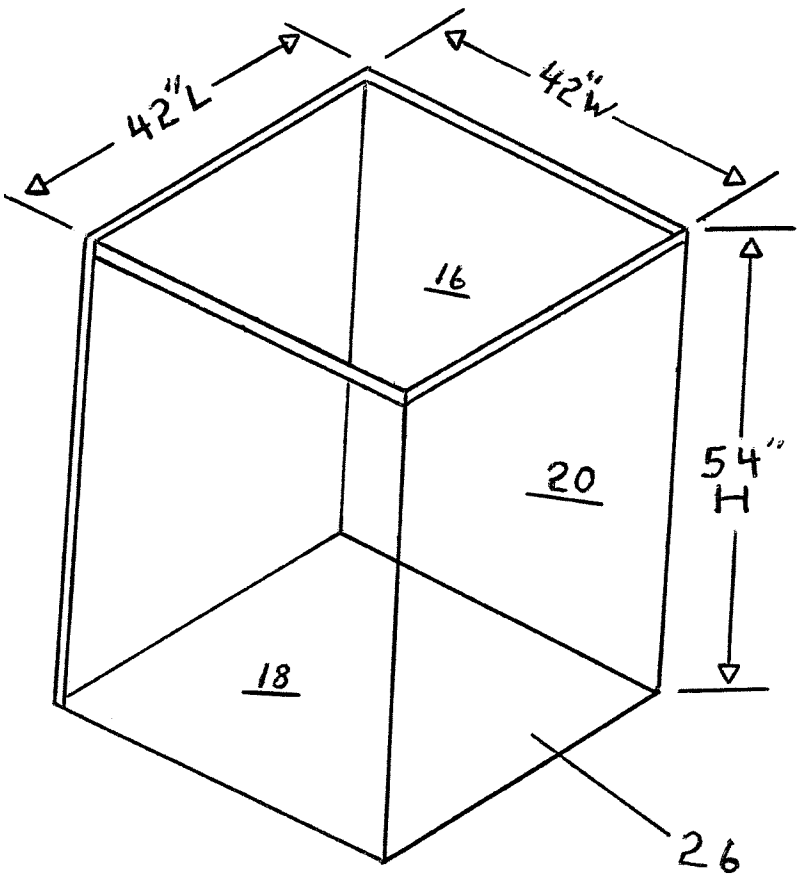
FIG. 3 is an external view of the container showing representative dimensions of the housing.
Figure 4:
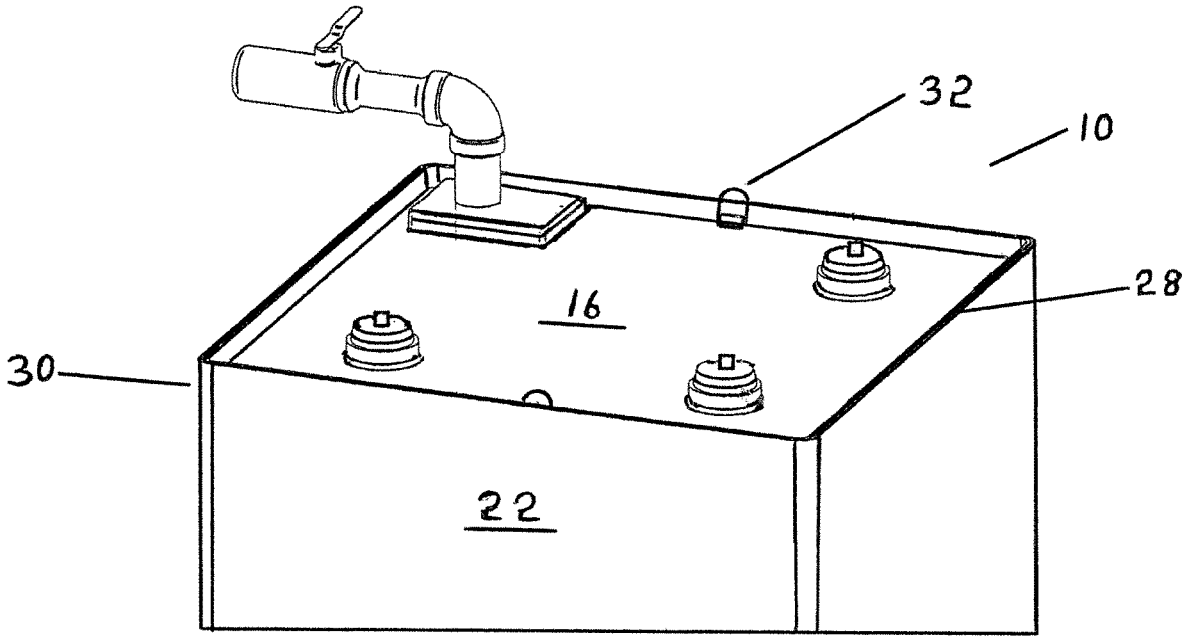
FIG. 4 is another view, close up, of the container showing the top wall and a side wall.

The drawings are seen to describe a fluid bearing container 10, which may be generally rectangular or square and typically comprises a housing 12 and a baffle assembly 14 (see FIG. 1B). The housing 12 may include a top wall 16, four side walls 18/20/22/24, and a bottom wall 26 (see FIG. 2). These walls are typically flat and unstructured except for the top wall, which is structured as set forth herein. Unstructured means the walls do not have any ports or external structure therethrough.

The top wall may be recessed so as to define a reinforced upstanding edge 28 for reinforcement purposes and for protection of elements on the top wall or for receiving a cap, as set forth in more detail below. The housing may include fluid tight rounded corners 30, which may include reinforced with added steel plates, the rounded corners for strength, where side wall side edges meet one another. Two or more walls may be configured from a sheet, such that the edges are bends in the sheet (see FIGS. 11A-11D).

Figure 16A:
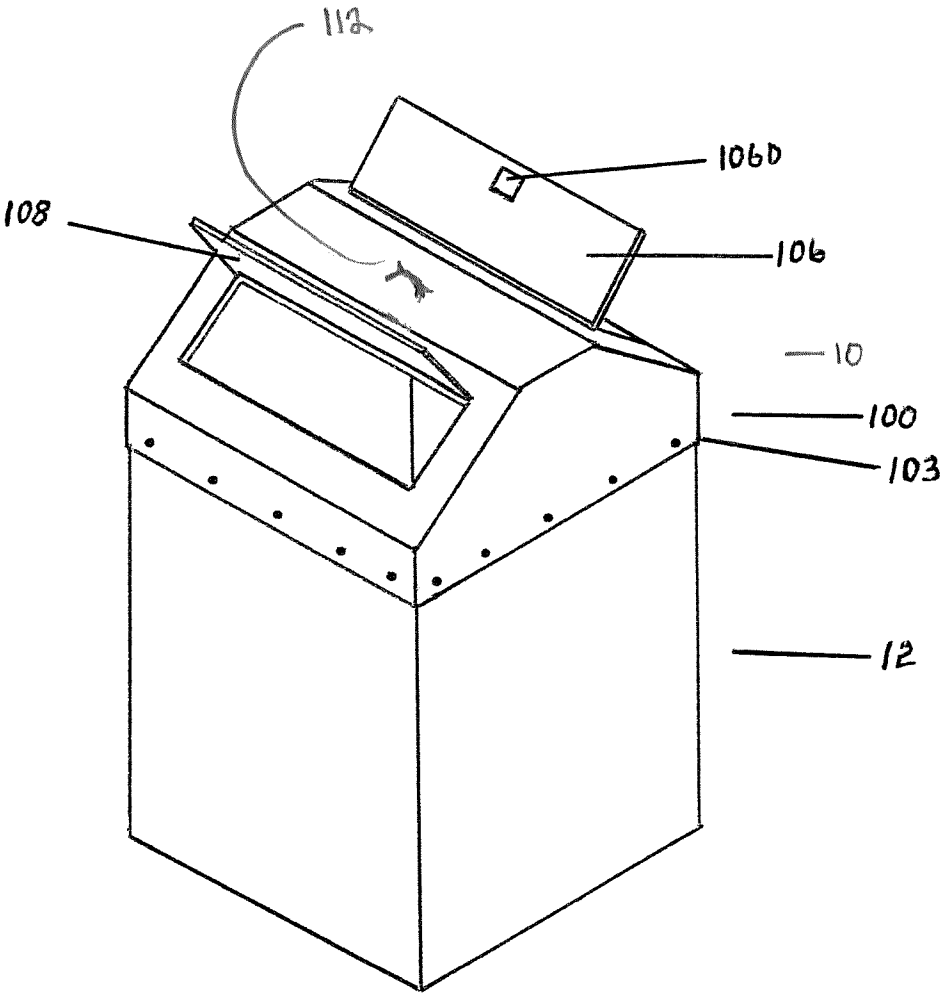
FIGS. 16A, 16B, and 16C are side elevation, front elevation, and isometric views of a pressurized, baffled fluid container having a containment cap.

The housing may be comprised of 10-12 gauge mild steel and welded up in ways known in the art or otherwise joined so as not to leak fluid or air pressure when pressurized. Lift clips 32 may be provided anywhere on the housing, but typically are somewhere along the top edges of the side walls of the housing as seen in FIG. 1 or as seen in FIG. 16A.

In some embodiments, there are no inlet ports or outlet ports or any other fill ports or other operational or measurement structure on any of the walls of the housing, except the top wall. In other embodiments, there are ports or valves on walls other than the top wall. As seen in FIGS. 1 and 1A, the top wall may include an air let 34 for pressurizing the interior of the housing. Air inlet 34 may include a pressure gauge 36 to determine the air pressure on a head H. Air pressure forces fluid F downward and into and up an inner draw tube 44 (see FIG. 1A) and out a valved outlet 42. The valved outlet may include a shutoff handle for operating flow of pressurized fluid out of the container. In some embodiments, an external air pump 38 is provided and may be connected to air inlet 34 through a flexible hose 40, so as to pressurize the interior of the housing, pressure in ranges typically of about 6 to 20 psi, or in one embodiment, about 10 psi.

It is seen in FIG. 1A that valved outlet 42 is fluidly coupled to inner draw tube 44 that extends down through the interior of the housing until it is close to and adjacently above the inner surface of bottom wall 26. More specifically, inner draw tube 44 has a removed end 44*a* which may include a check valve 44*b* (allowing fluid to flow up, not down) to prevent backdraw when valve 42 is open.

Other elements may be included on top wall 16, including a fuel level gauge 46 with fuel level sensors or extenders extending into the interior to measure the fuel level FL (see FIG. 1A). A fluid fill port 48 may be provided with a screw cap 48*a*, the screw cap which can be removed and allow one to fill housing 12 with a fluid, such as petroleum based fluids lubricants, fuel, mine waste, and the like. A pressure relief valve 50 may be provided as one of the elements engaging top wall 16, to prevent an over-pressure situation.

One of the novelties of Applicant's fluid container 10 lies in the structure and function of baffle assembly 52. It achieves both a housing strengthening function as well as fluid surge reduction. Baffle assembly 52 is dimensioned to be received within the interior of housing 12 and, in one embodiment, to extend from the bottom to the top as set forth in more detail below. Baffle assembly 52 may include a vertical baffle 54 and horizontal elements 56, such as plates. Vertical baffle 54 may include one or more vertical baffle plates, here four designated 58/60/62/64. In addition, the horizontal elements may include on or a multiplicity of horizontal, open, surround plates 66/68/70 provided to maintain structural integrity by, for example, weldment and further baffle the fluid contents of the housing to prevent sloshing during movement of the container.

Figure 7:
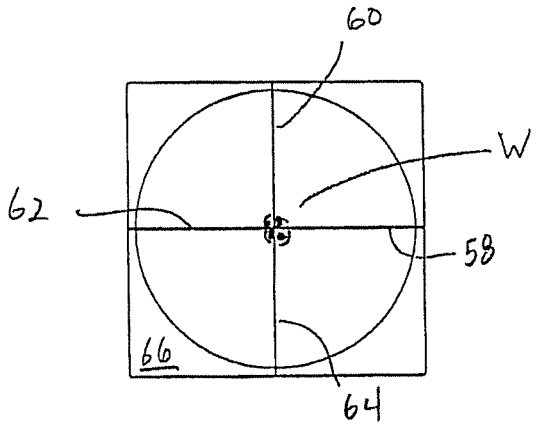
Figure 7A:
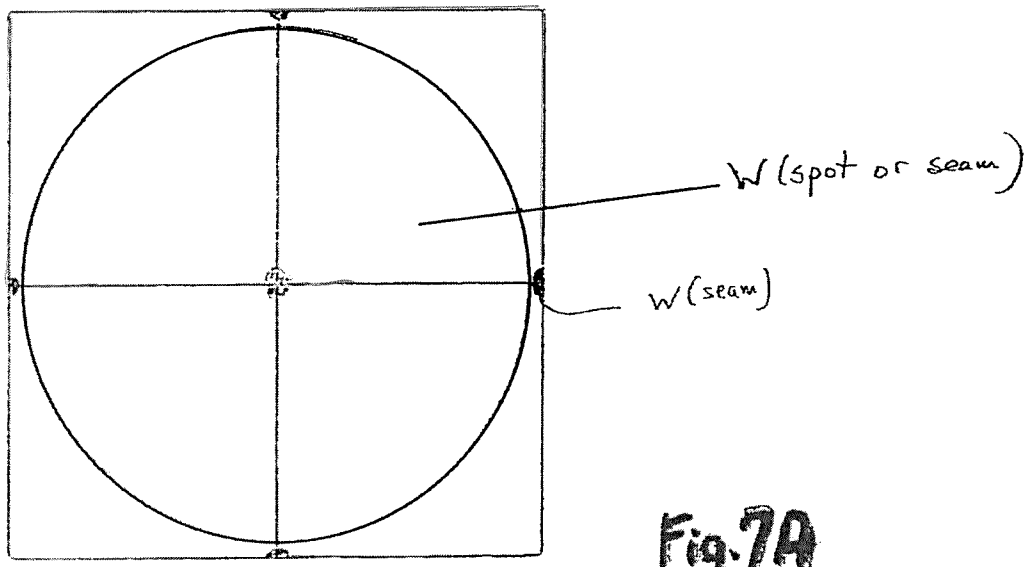
FIG. 7A is a top view of the baffle assembly.
Figure 8B:
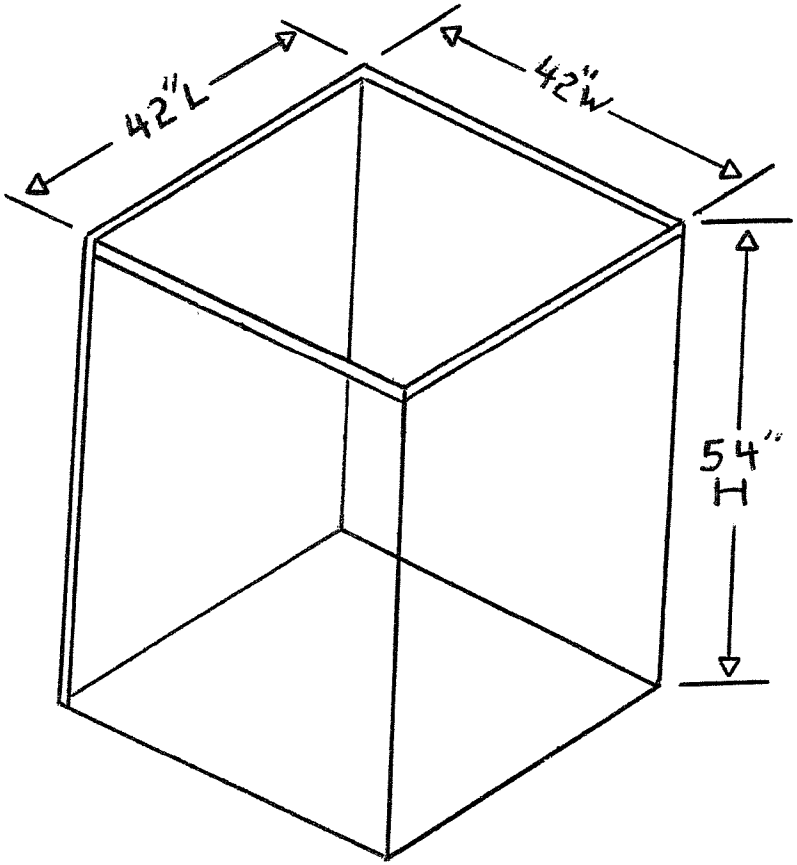
FIGS. 8A and 8B are perspective views of the housing showing additional dimensions, including some examples of dimensions for the baffle assembly.
Figure 8A:
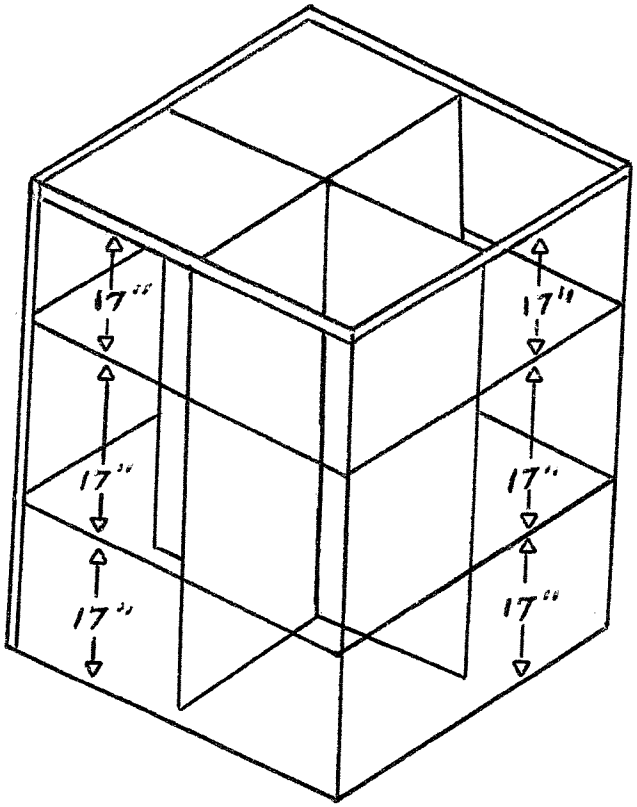

Turning back to the vertical plates of baffle assembly 52 and with reference to FIGS. 7 and 7A, the four, in some embodiments, are seen to be oriented perpendicular to one another and attached by welds to their cooperating side edges, so as to divide the interior of the housing into four equal quadrant volumes. Moreover, one or more (typically all four) of the vertical plates, which may be joined along their side edges by welding or other means, may have a contoured lower edge 72, which may include a flat lower section 72*a* for laying on the upper surface of bottom wall 26 (see FIG. 5A). Contoured lower edge 72 may also include an up cut section 72*b*, which allows the vertical plates or vertical baffle 54 and fluid, otherwise separated, to fluidly communicate with one another, but only at the lower edge thereof (while still allowing the portion of the lower edge contacting the inner surface of the bottom wall to, in some embodiments, be welded together). In one embodiment, the height of up cut section 72*b* is in the range of 6 to 12 inches. In one embodiment, the top edges and bottom edges of the vertical plates may be spot welded to the inner surface of the top wall and bottom wall for structural integrity (but not fluid sealing) and to the inner sidewalls of the housing and/or the vertical baffle plates. FIGS. 8A and 8B illustrate some of the dimensions of an embodiment of the container (in inches).

Figure 5:
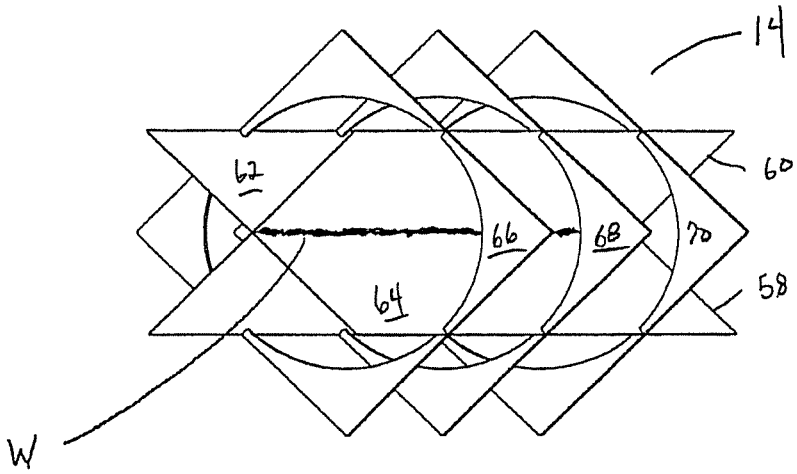
FIGS. 5, 5A, 6, 6A, 6B, and 7 are all various views of the baffle assembly designed to fit inside the housing of the container.
Figure 6:
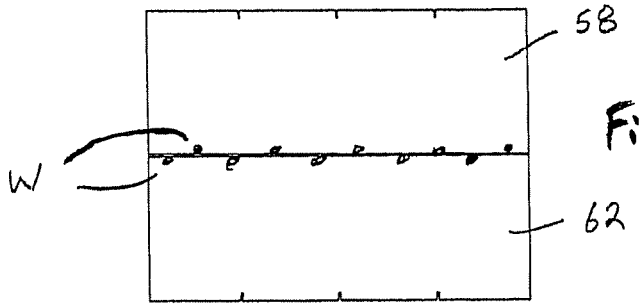
Figure 5A:
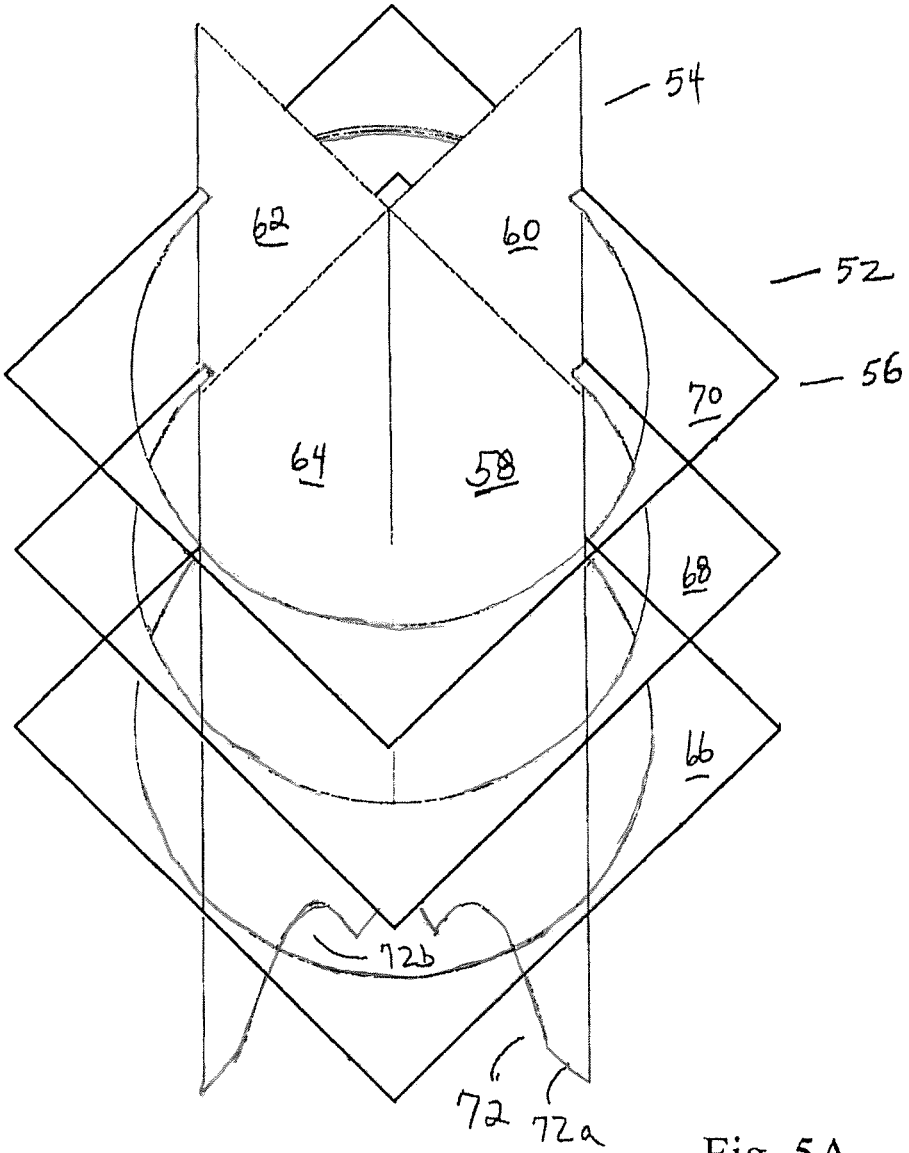
Figure 6B:
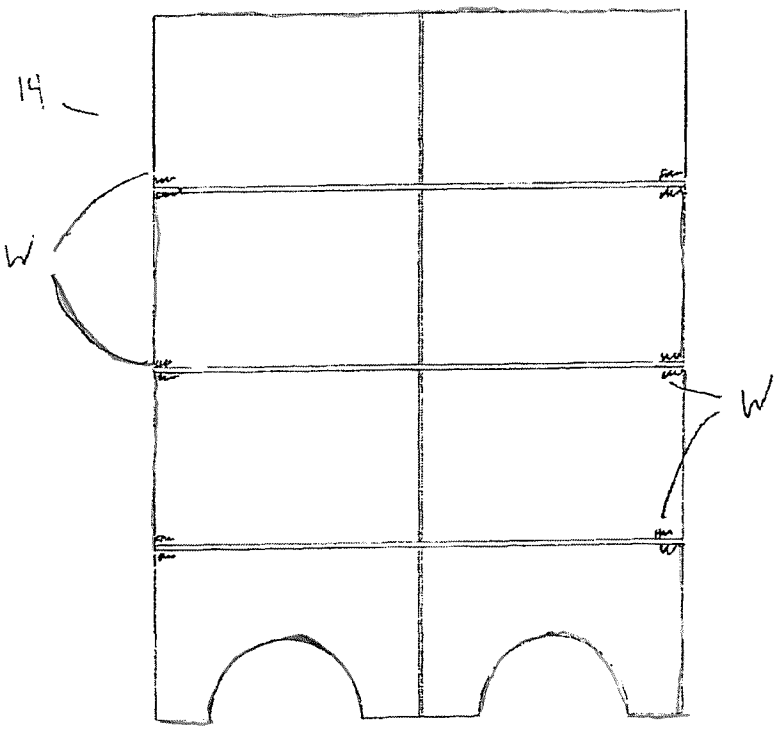
Figure 6A:
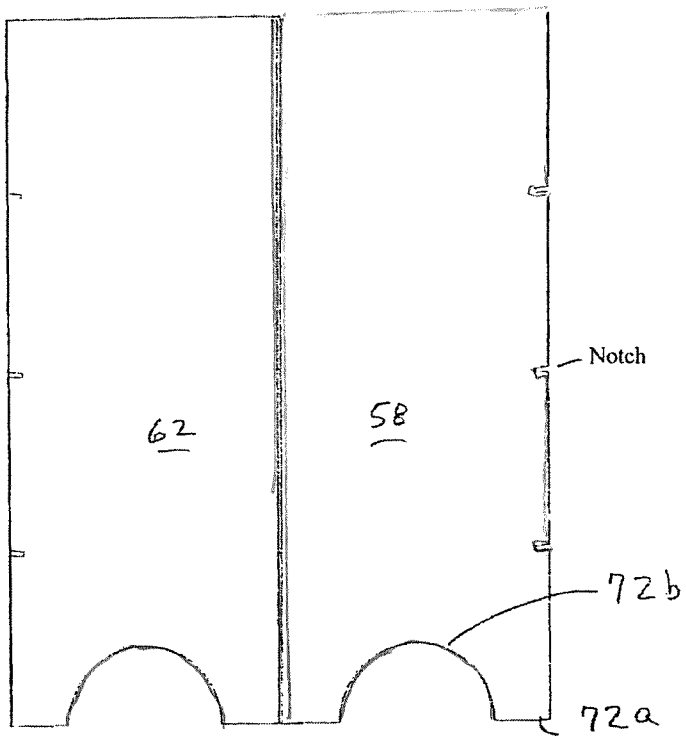

Plates 58/60/62/64/66/68/70 may be grooved or notched to fit into one another as illustrated in FIGS. 5, 5A, and 6, and may be welded up for strength and, after being welded up, inserted into the rectangular interior of housing 12. It is seen that providing such a baffle assembly effectively breaks down a large volume into, in some embodiments, four smaller volumes and, therefore, help prevent surging of the fluid within the interior; and also provides for structural integrity.

FIG. 1B is a three dimensional shaded transparent illustration of the fuel container showing housing 12 and the baffle assembly fitting inside of the interior of the housing. One can see from FIG. 1B, the manner in which vertical plates 58/60/62/64 and horizontal round open plates 68/70 (here, two) fit within the interior of the housing.

Figure 9C:
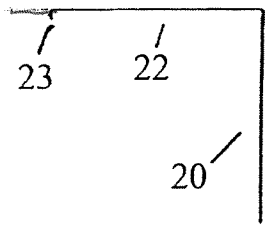
FIGS. 9A, 9B, and 9C are side, side, and top views of a manner in which two side walls may be engaged by bending.
Figure 9B:
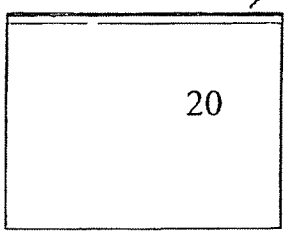
Figure 9A:
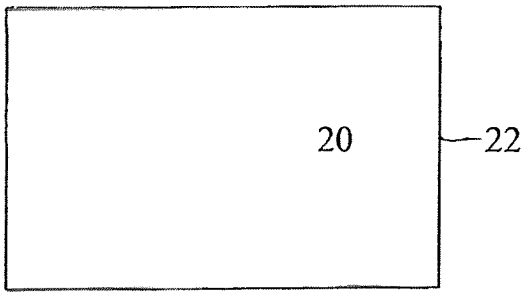

FIGS. 9A, 9B, and 9C illustrate two sides 20/22 formed from a single piece of material, such as ¼ inch A36 steel with a lip 23 for engaging a mirror image, a bent single sheet two-sided material for sides 18/24. Sides 18/24 may also be made from a single sheet with a lip to be welded with two seam welds, for example. In this manner, there will be only two full seam welds necessary for a side wall assembly.

Figures 10A, 10B, 10C:
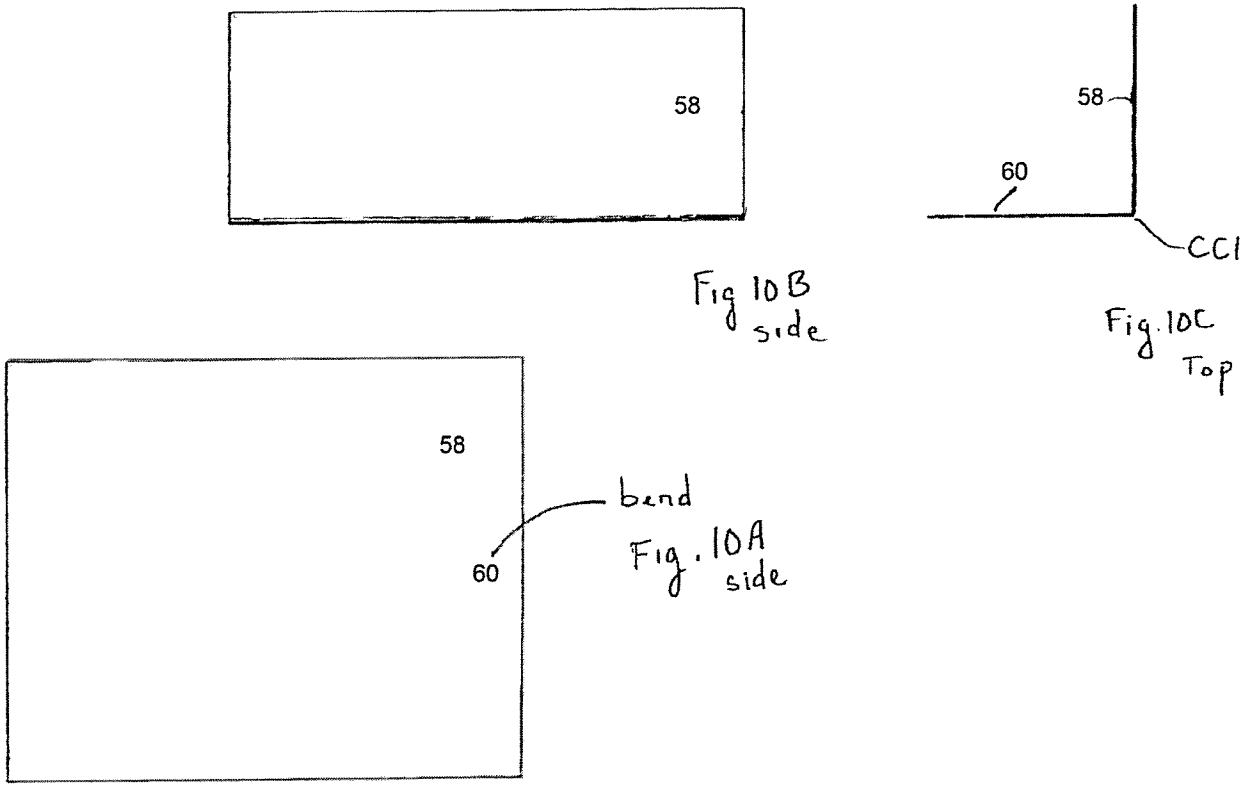
FIGS. 10A, 10B, and 10C are side, side, and top views of first subassembly for the vertical baffle assembly.

FIGS. 10A, 10B, and 10C illustrate a first integral assembly having first vertical plate and second vertical plate 58/60 formed from a single sheet bent at 90° with similar treatment to second vertical plate 60/62 (see next paragraph) with the two pieces then welded back to back to create vertical baffles 54.

Figure 11C:
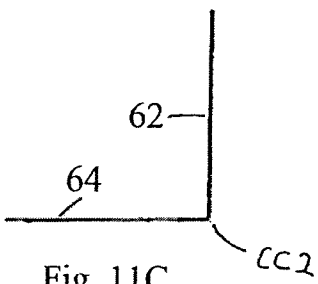
FIGS. 11A, 11B, and 11C are side, side, and top views of a second subassembly for the vertical baffle assembly, the second subassembly to engage the first subassembly as by welding.
Figure 11B:
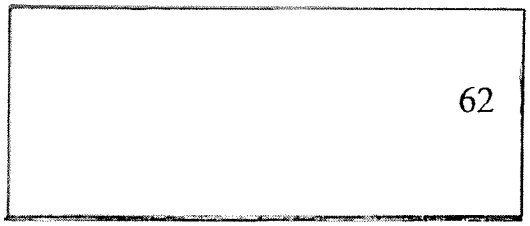
Figure 11A:
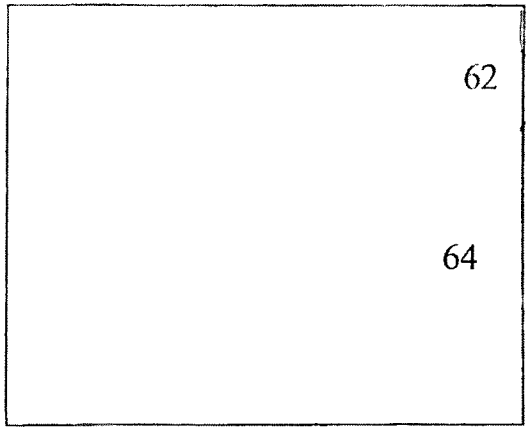
Figure 11D:
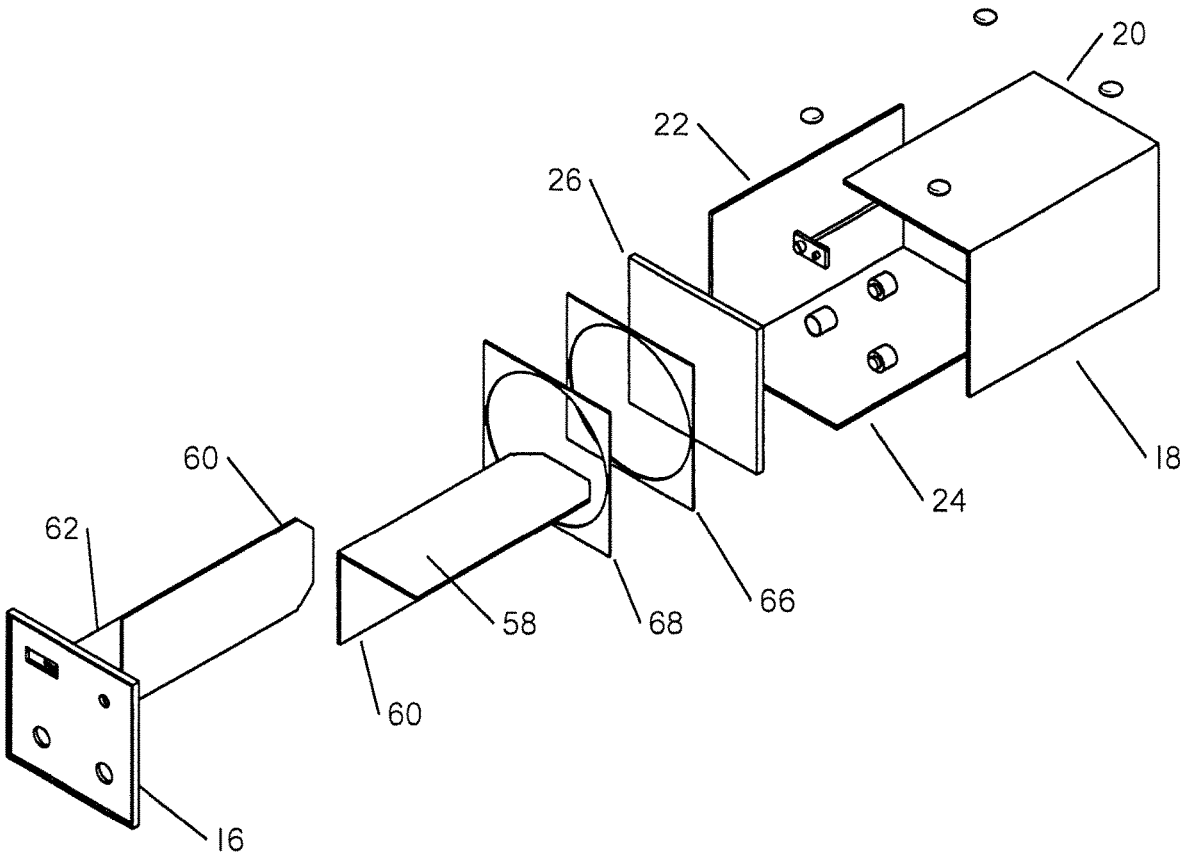
FIG. 11D is an exploded isometric view of the two subassemblies and the manner of their engagement with the side walls and horizontal surround plates.

FIGS. 11A, 11B, 110, and 11D are a second integral assembly with CC1 from first assembly 58/60 and CC2 from second assembly 62/64 joining together and receiving welds on the non-integral corners thereof to form a vertical baffle 54. In some embodiments, these two assemblies may be made of ¼ inch A36 steel. FIG. 11A illustrates an angle of about 0.7° to show a taper on the bottom tank for draining purposes. Bottom wall 26 may be tapered slightly towards removed end 44*a* of inner draw tube 44 (see FIG. 1A). Such a taper would help allow removal of all fluids or at least substantially all fluids from the interior of the pressurized container. This illustration does not show the upcut sections 72*b* of FIG. 5A, but which would typically be used along with the taper.

Figure 12D:
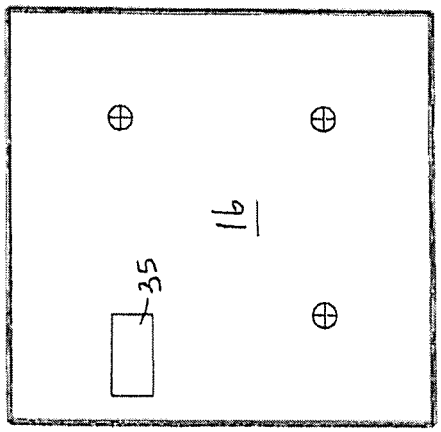
FIGS. 12A, 12B, 12C, and 12D are top, side, side, and bottom views of the top wall of the container apart from the container itself.
Figure 12B:
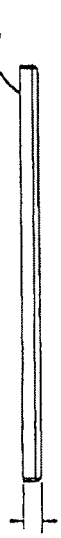
Figure 12C:
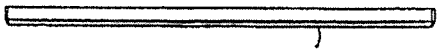
Figure 12A:
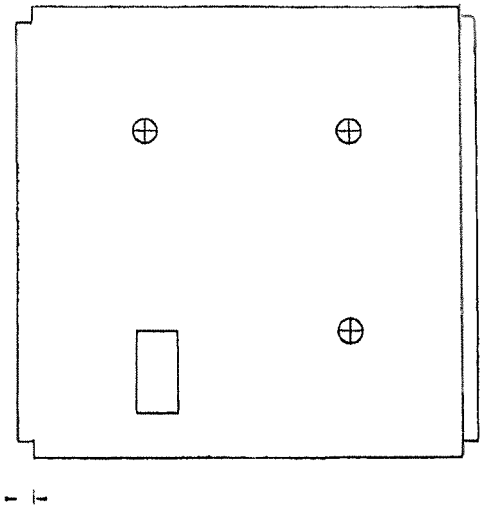

FIGS. 12A, 12B, 12C, and 12D show views of top wall 16 showing upstanding edges 28 (four). FIG. 12A shows the top wall prior to bending the edges upward, whereas FIGS. 12B, 12C, and 12D all show the edges upstanding. FIGS. 12A and 12B show cutouts 35 for air in/fuel out (see FIG. 1), as well as cutouts for fitting a neck for a screw cap 48*a* of fill port 48, as well as a cutout for fuel level gauge 46 and pressure relief valve 50.

Figures 13A, 13B, 13C, 13D:
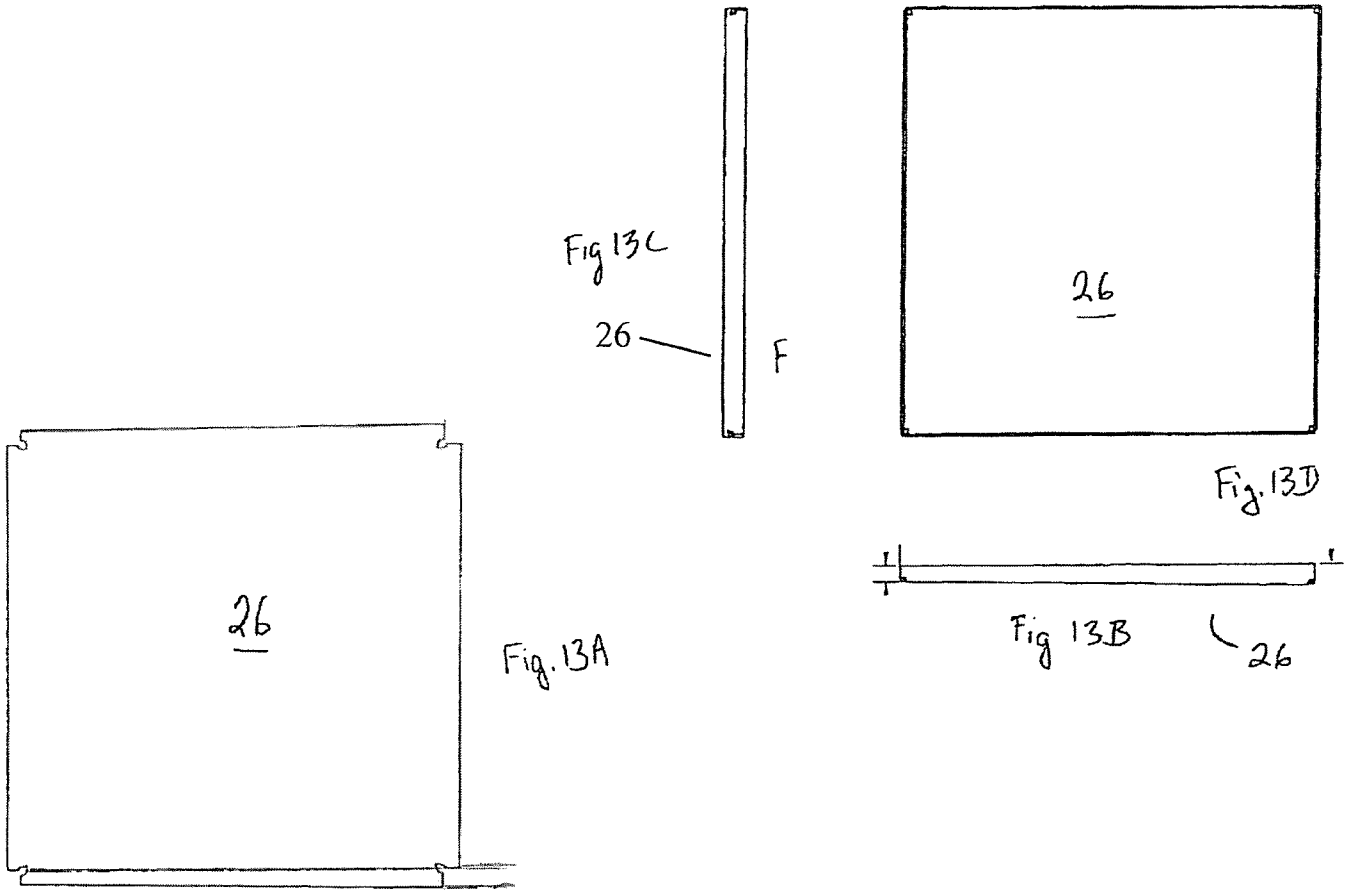
FIGS. 13A, 13B, 13C, and 13D are top, side, side, and bottom views of the bottom wall of the container apart from the container itself.

FIGS. 13A, 13B, 13C, and 13D illustrate bottom wall 26, with side view FIG. 13B showing the drop, left to right, of about ½ inch along the bottom (same on the other side) to allow for fluid to drain left to right towards the removed end of the inner drain tube 42 to help remove fluid as much as possible from the pressurized container. It may help to go back to FIG. 1A to see how bottom wall 26 is inserted up into the interior and welded in so the bottom edges of the side walls sit on the support surface and are vertical, but bottom slopes towards 44*a*.

Figure 14A:
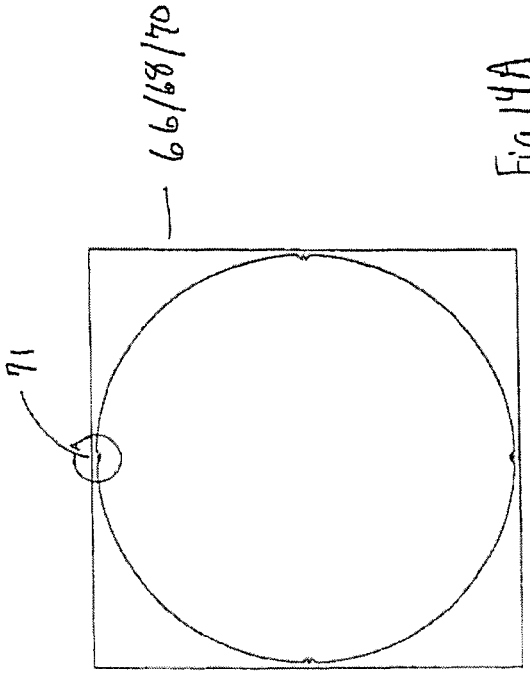
FIGS. 14A and 14B are details of horizontal opened surround plate for use in the baffle assembly.
Figure 14B:
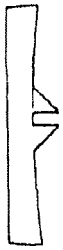

FIGS. 14A and 14B illustrate horizontal surround open plates 66/68/70 (may be one, two, three or more) and the manner in which the notch 71 is provided so they may slideably engage the vertical plates of vertical baffle 54. They may be tack welded to the vertical plates and some, none or all of the outer edges of the horizontal surround open plates may be welded to the inner surface of the complementary side walls.

Figure 15A:
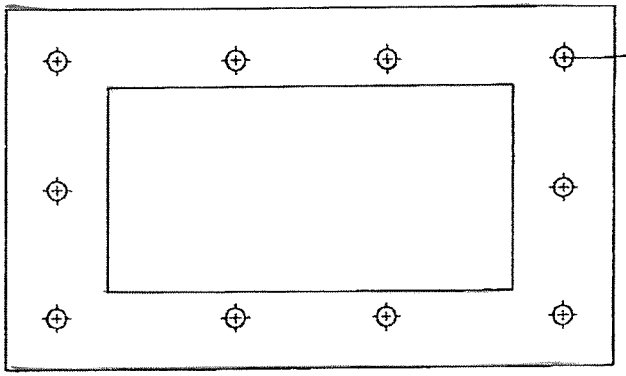
FIGS. 15A and 15B are top views of a first and second plate used to mount the air fill valve and the fuel outflow valve of the container to the top wall.
Figure 15B:
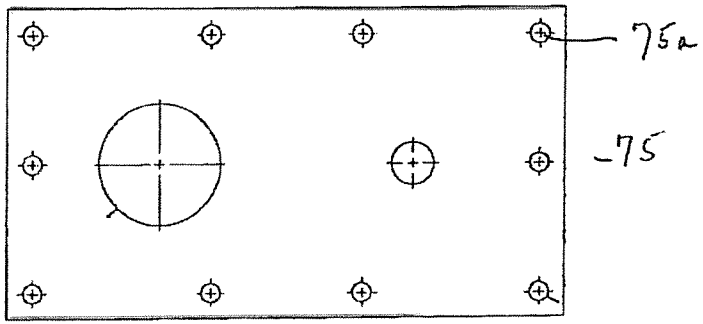

FIGS. 15A and 15B illustrate a pair of plates 74/75 that may stack together to mount air inlet 34 and valved outlet 42. Lower plate 74 may engage a cutout of the top wall, upper plate 75 may sit atop lower plate 74, and fastener holes 74*a*/75*a* align with fastener holes in the top wall to hold them down tight against the top wall, with gasket elements used between any plates or the plates in the top wall so as to help the fluid seal and make airtight the seal of the plates to the top wall and the valved air inlet/outlet.

Figure 16C:
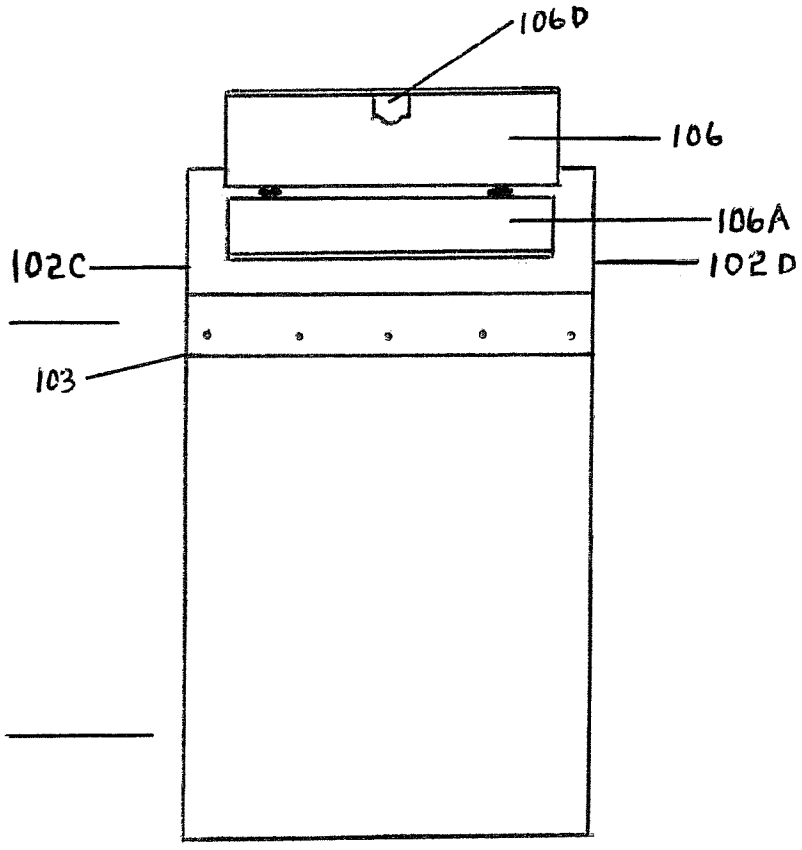
Figure 16B:
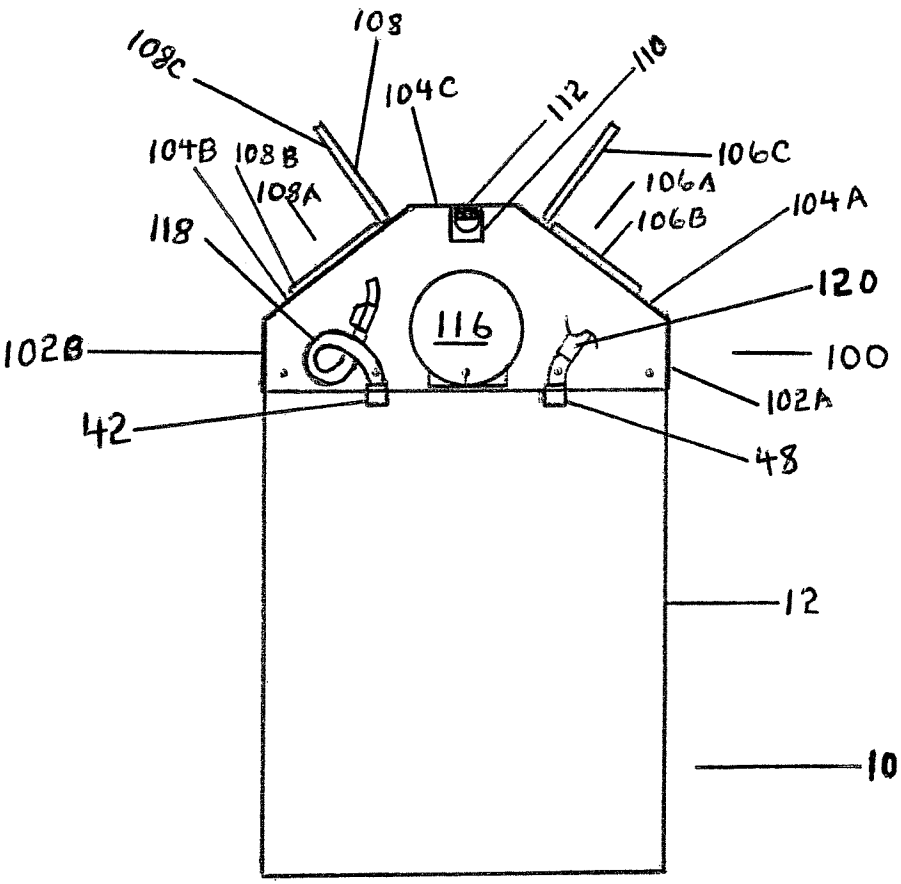

In a preferred embodiment of Applicant's container 10, as seen in FIGS. 16A, 16B, and 16C, an open bottom containment cap 100 is provided having a lower perimeter 103 which, in some embodiments, fluid sealingly engages, as through fasteners, pop rivets, and the like, the upstanding edge 28 of housing 12 as illustrated. Containment cap 100 is provided, in some embodiments, with vertical side walls 102*a*/102*b*/102*c*/102*d*, the lower edges defining perimeter 103. Top walls 104*a*/104*b*/104*c* (usually two of which may be sloped) are provided into at least one door or doors (here two) 106/108 open, defining at least one (here two) access openings 106*a*/108*a*.

Opening 106*d* in door 106 defines a lock opening in the door and opening 102*b* in side wall 102 to which a padlock or other lock means may be inserted to lock the door in a closed position—other locking means, such as a hasp and eye may also be used. Thus, containment cap 100 effectively seals access to the valves, gauges, ports, battery, pump, hoses, and other devices on the top wall of housing 12 (see, for example, FIG. 1 or FIG. 17). As Applicant's container may be used in remote locations, the theft of the contents thereof, such as diesel fuel or gasoline, may be a problem. By providing containment cap 100, especially with doors and locking means, unauthorized access is either prevented or made more difficult.

Moreover, it is seen in FIG. 16B that containment cap 100 may be dimensioned to receive a captive air tank 116 (or other source of compressed gas), the captive air tank to pressurize the container as set forth hereinabove. The term "captive air tank" means an air tank that is pressurized and may be connected to the air fill port to provide pressure without a generator or other pressure pump. Also, it is seen in FIG. 16B that valve outlet 42 may be provided with hose and nozzle assembly 118 that will fit within the container cap, but allow for filling a vessel outside of the container tank. Likewise, fill port 48 may have a fill hose 120 for coiling up and receipt into the containment cap attached thereto.

It can be seen that the four vertical side walls may be dimensioned slightly larger so as to engage upstanding edge 28 of housing 12. Top walls 104*a*/104*b*/104*c* may include opposed inclined top walls 104*a*/104*b* and horizontal top wall 104*c* in one embodiment. Horizontal top wall 104*c* may include a reinforcement load bar 110, typically welded or otherwise fastened to one or more walls of the containment cap 100 and having, centrally located thereon, lifting bracket 112. Lifting bracket 112 will allow entire container 10 to be lifted onto a flatbed truck with a crane or other lifting mechanism, or offloaded at a remote site.

There may be one or more doors 106/108, and it is seen that the doors are hinged to either obscure or provide access to access openings 106*a*/108*a*, which may be defined by a perimeter lip 106*b*/108*b*, which engages perimeter lip 106*c*.

In addition to providing both weatherproofing and limited or no unauthorized access to elements in the top of housing 12, it is seen, in some embodiments, that vertical side walls extend, here about six inches, above upstanding edge 28 of housing 12. Furthermore, at the junction of upstanding edge 28 and perimeter 103, there may be fuel tight gasket sealing or other means, such that if there was an overflow at the top of the tank or a spill, such as at the valves and ports at the top of the tank (in one example, warm fuel expansion from a full tank), it is seen that because the side walls are raised, fuel will not spill on the ground. Thus, containment cap contains fuel leakage from the housing and also unauthorized access to elements on the container or fuel hoses, air tanks and the like. The containment cap may be vented on one, two or more sides to provide for ventilation of the interior so as to prevent the buildup of gaseous fumes.

Figure 17:
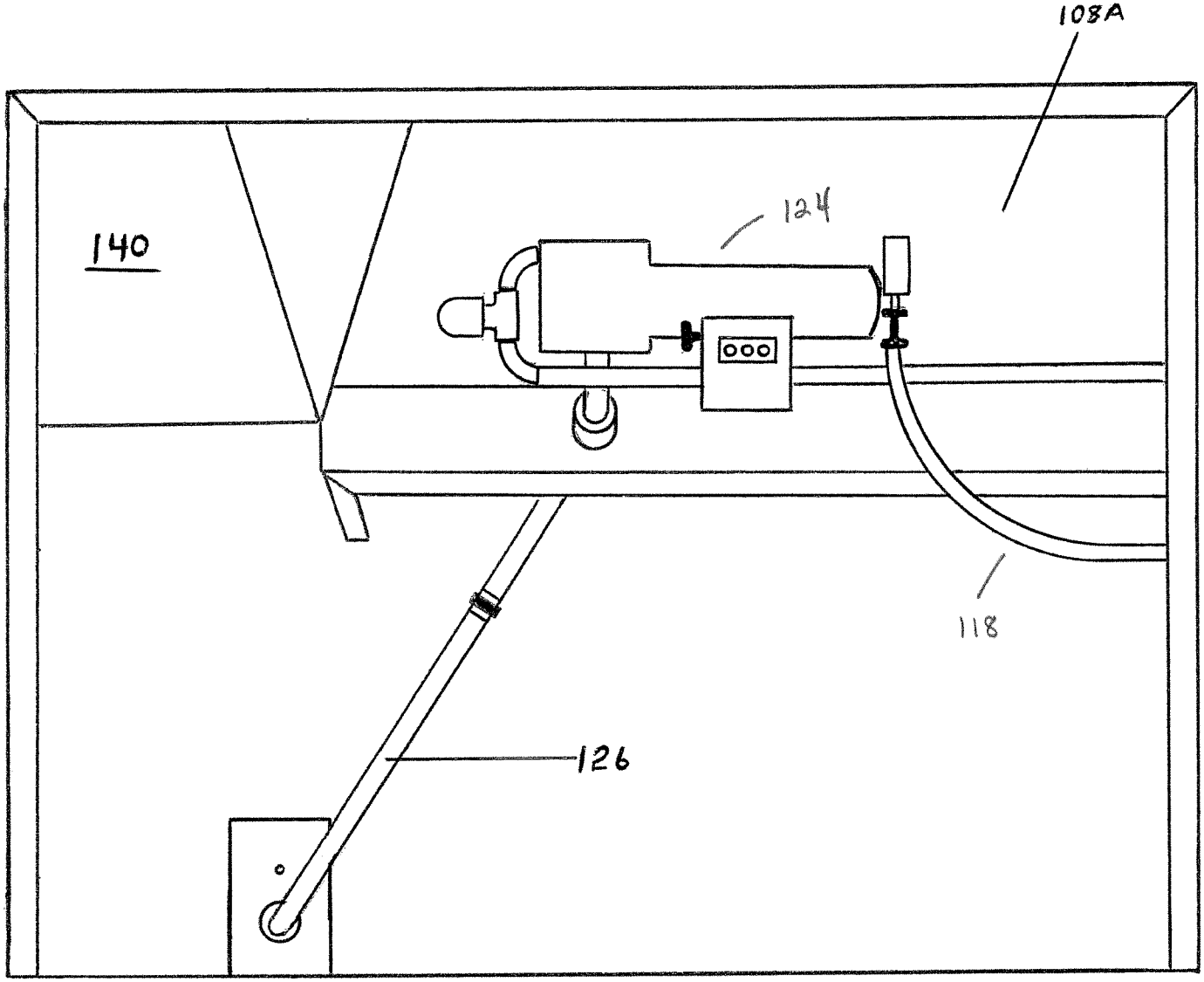
FIG. 17 is a perspective view of an embodiment, which includes an electric fluid pump for pumping fluids out of the container into a remote vessel (not shown).
Figure 18:
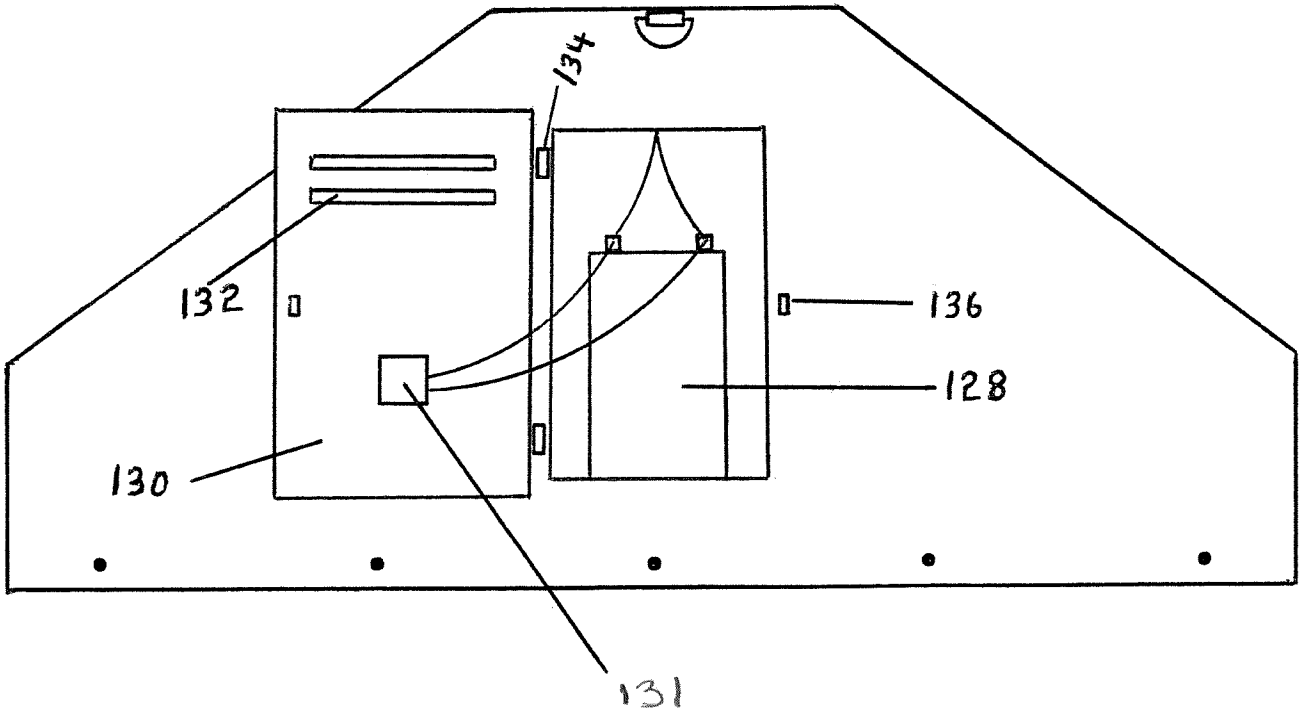
FIG. 18 illustrates a battery, a battery door for accessing the battery, and a battery compartment, the battery for powering any elements of Applicant's invention, including the electric pump illustrated in FIG. 17.
Figure 19:
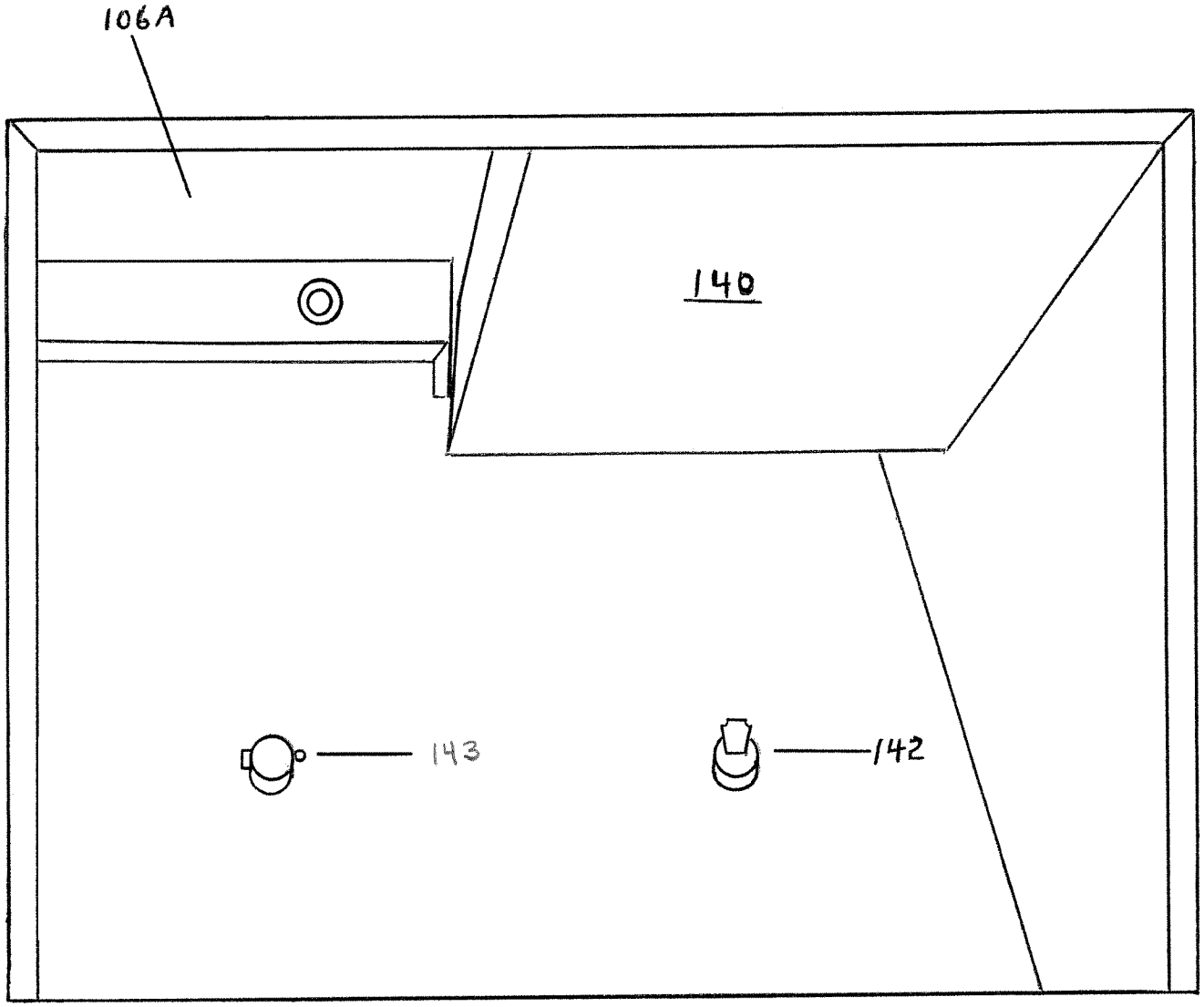
FIG. 19 illustrates a separate compartment for the DC battery which, in some embodiments, isolates the battery from the rest of the assembly. In some embodiments, the battery compartment is fluid tight with respect to the interior of the cap.

FIGS. 17, 18, and 19 illustrate additional features of Applicant's baffled fluid container assembly. None of the embodiments in these specifications need to be pressurized, but they may be. In some embodiments, an air pump 116 may be provided to pressurize the tank and drive fluids out of the tank (see FIG. 16B). In some embodiments, as seen in FIG. 17A, fluid pump 124, such as a DC battery powered electric fluid pump, may be provided connected by conduit 126 to a fluid draw tube (see 44, FIG. 1) that descends into the body of the container with a remote opening near the bottom thereof for drawing fluid out when the pump is energized and dispensing through hose and nozzle assembly 118. These elements may, in some embodiments, be mounted within the cap of the container to prevent unauthorized access.

FIG. 18 illustrates the use of a battery 128, such as a 12 volt DC car or deep cycle marine type battery, for energizing any elements, including without limit, a compressor for providing regulated compressed air to the container, and/or a fluid pump, such fluid pump 124 seen in FIG. 17. Battery 128 may, in some embodiments, be accessed through a separate battery door 130 which, in some embodiments, may be include vents 132. Indeed vents 132 may be found on any other walls of the cap to provide air circulation through the cap. A hasp 136 may be provided, as well as door hinges 134. Hasp 136 may be used along with a padlock to prevent unauthorized access to the battery. Charge monitor/controller 131 is located between the solar panel 144 (see FIG. 20) and indicates a charged/charging condition of the battery.

FIG. 19 illustrates an area of the interior of the cap that shows a fully walled battery container 140 (having at least a sealed floor) for isolating the battery from the rest of the assembly to avoid battery acid drip onto the container top or on any other elements. FIG. 19 also illustrates vent 142 for venting the fluid pump version of the container and fuel fill cap 143. Battery box 140 is airtight except at the vented door, so as to prevent harmful potentially explosive fumes from getting into containment cap area.

Figure 20:
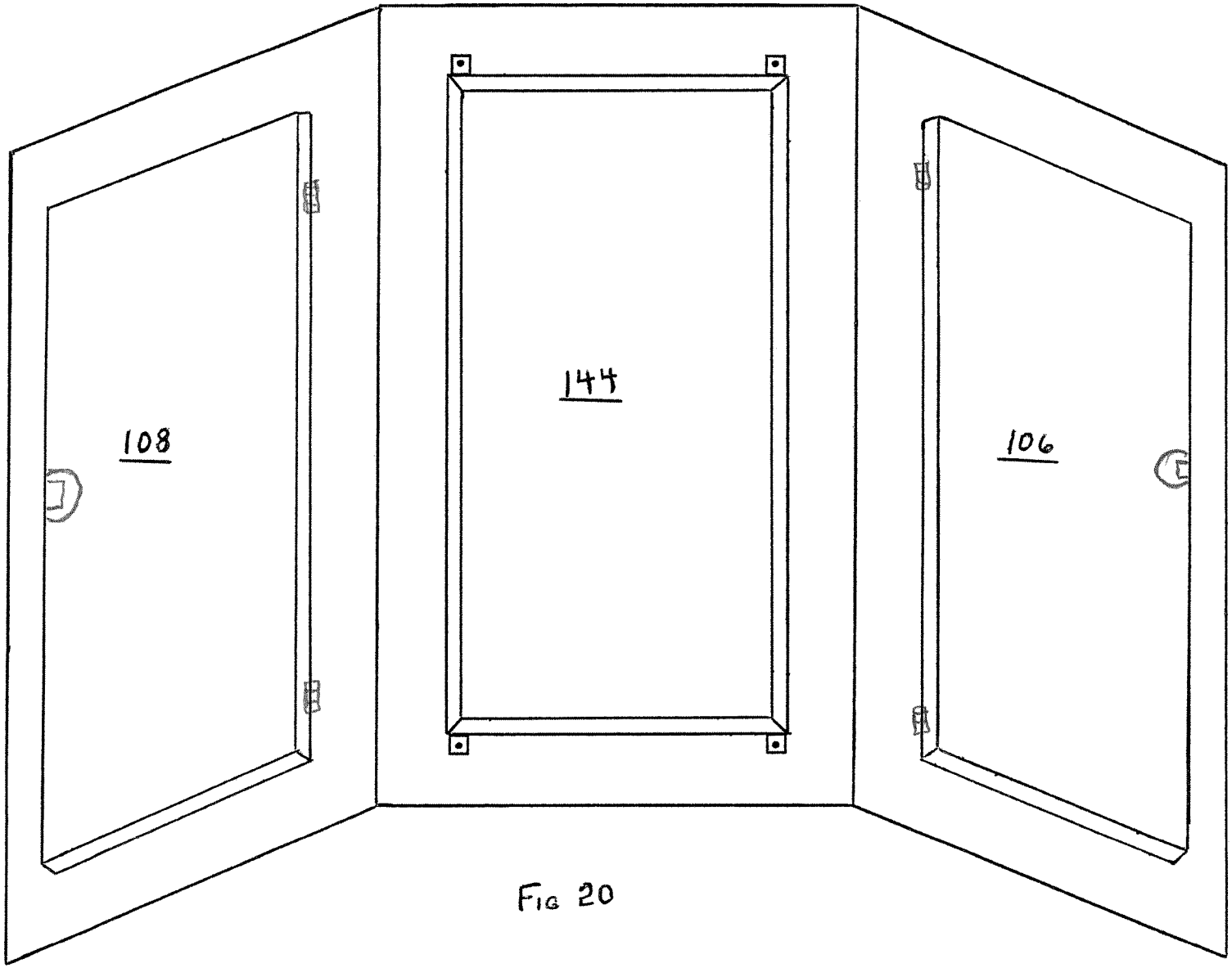
FIG. 20 illustrates the use of a solar panel for use with a charging unit (not shown) for charging the battery (see FIG. 18).

FIG. 20 illustrates the use of a solar panel 144 (such as an Ironton® 30w) on the top of the cap or any other suitable location on the exterior walls of the tank, the solar panel for providing charge to the DC battery or providing current to any other location or any other element of Applicant's embodiments disclosed herein.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A fluid container comprising:

an air and fluid tight a housing comprising multiple outer walls, the walls including a top wall, a bottom wall, and four side walls, the six walls defining an interior volume, the housing having a length, width, and height, and a vertical axis; and a baffle assembly dimensioned to fit within the interior of the housing comprising a multiplicity of vertical walls oriented such that they bisect the inner volume into multiple spaces, each vertical wall having side edges, a top edge and a bottom edge, the baffle assembly further comprising at least one horizontal plate, at least some of the vertical walls welded to an inner surface of at least some of the side walls, and at least some of the top edges and bottom edges welded to an inner surfaces of at least one of the top wall and bottom wall;

wherein at least some of the walls of the housing engage one another in fluid sealing relation;

a containment cap having side walls and a top wall for enclosing the liquid fill valve or port, the air inlet and liquid outlet; and a compressed gas source dimensioned to fit within the containment cap.

2. The fluid container of claim 1, further including a liquid fill valve or port, an air inlet, and a liquid outlet each engaged with the top wall of the housing in fluid tight engagement with the inner volume.

3. The fluid container of claim 2, further including an inner draw tube engaged with the liquid outlet, the inner draw tube with a near and removed end, the removed end adjacent and above an inner surface of the bottom wall and the near end engaging the liquid outlet.

4. The fluid container of claim 3, wherein the bottom wall is sloped towards the removed end of the inner draw tube and the inner draw tube includes a check valve.

5. The fluid container of claim 4, wherein the housing is square or rectangular, and there are no valves or ports or other openings on any of the walls except the top wall.

6. The fluid container of claim 1, wherein some, but not all, of the four side walls are full seam welded at complementary edges.

7. The fluid container of claim 1, wherein at least some of the walls comprise steel.

8. The fluid container of claim 7, wherein the walls are between 3/16" and 1" thick.

9. The fluid container of claim 1, wherein at least some of the edges of some of the vertical walls of the baffled assembly are raised to provide fluid communication from one of the multiple spaces to another of the multiple spaces.

10. The fluid container of claim 1, further including lift clips engaging the housing.

11. The fluid container of claim 1, further including a liquid fill valve, an air inlet, and a liquid outlet on the top wall thereof in fluid tight engagement with the inner volume; further including an inner draw tube with a near and removed end, the removed end adjacent and above an inner surface of the bottom wall and the near end engaging the liquid outlet; and wherein at least some of the four side walls are full seam welded at complementary edges.

12. The fluid container of claim 11, wherein at least some of the edges are vertical.

13. The fluid container of claim 1, further including a fluid level gauge.

14. The fluid container of claim 1, further including a battery, a solar panel for charging the battery, and a fluid pump.

15. The fluid container of claim 1, further including a gas compressor for engaging the interior volume.

16. The fluid container of claim 15, further including a gas regulator.

17. A fluid container comprising:

an air and fluid tight housing comprising multiple outer walls, the walls including a top wall, a bottom wall, and four side walls, the six walls defining an interior volume, the housing having a length, width, and height, and a vertical axis; and a baffle assembly dimensioned to fit within the interior of the housing comprising a multiplicity of vertical walls oriented such that they bisect the inner volume into multiple spaces, each vertical wall having side edges, a top edge and a bottom edge, the baffle assembly further comprising at least one horizontal plate, at least some of the vertical walls welded to an inner surface of at least some of the side walls, and at least some of the top edges and bottom edges welded to an inner surfaces of at least one of the top wall and bottom wall;

wherein at least some of the walls of the housing engage one another in fluid sealing relation;

further including a liquid fill valve or port, an air inlet, and a liquid outlet each engaged with the top wall of the housing in fluid tight engagement with the inner volume;

further including a containment cap having side walls and a top wall for enclosing the liquid fill valve or port, the air inlet and liquid outlet;

further including a compressed gas source dimensioned to fit within the containment cap.

18. The fluid container of claim 17, further including a dispensing hose and nozzle assembly.

19. The fluid container of claim 17, further including a fill pipe for engaging the liquid fill valve.

20. A fluid container comprising:

a housing comprising multiple walls, the walls including a top wall, a bottom wall, and four side walls, the six steel walls defining an interior volume, the housing having a length, width, and height, and a vertical axis;

a baffle assembly dimensioned to fit within the interior of the housing comprising a multiplicity of vertical walls oriented such that they bisect the inner volume into multiple spaces, each vertical wall having side edges, a top edge and a bottom edge, the baffle assembly further comprising at least one horizontal plate, at least some of the vertical walls welded to an inner surface of at least some of the side walls, and at least some of the top edges and bottom edges welded to an inner surfaces of at least one of the top wall and bottom wall;

wherein the walls of the housing engage one another in fluid sealing relation;

further including a liquid fill valve, an air inlet, and a liquid outlet each engaged with the top wall of the housing in fluid tight engagement with the inner volume;

further including an inner draw tube engaged with the liquid outlet, the inner draw tube with a near and removed end, the removed end adjacent and above an inner surface of the bottom wall and the near end engaging the liquid outlet;

wherein the bottom wall is sloped towards the removed end of the inner draw tube; and wherein some, but not all, of the four side walls are full seam welded at complementary edges;

further including a containment cap;

further including a compressed gas tank dimensioned to fit within the containment cap;

further including a hose and nozzle assembly;

further including a fill hose for engaging the liquid fill valve;

wherein the housing is square or rectangular;

wherein at least some of the walls are made of steel; and further including a battery and an electric, battery powered liquid pump engaged to the liquid outlet for dispensing fluid from the container.

21. A fluid container comprising:

an air and fluid tight housing comprising multiple outer walls, the walls including a top wall, a bottom wall, and four side walls, the six steel walls defining an interior volume, the housing having a length, width, and height, and a vertical axis;

a liquid fill valve or port, an air inlet, and a liquid outlet;

a baffle assembly dimensioned to fit within the interior of the housing comprising a multiplicity of vertical walls oriented such that they bisect the inner volume into multiple spaces, each vertical wall having side edges, a top edge and a bottom edge, the baffle assembly further comprising at least one horizontal plate, at least some of the vertical walls welded to an inner surface of at least some of the side walls, and at least some of the top edges and bottom edges welded to an inner surfaces of at least one of the top wall and bottom wall; and further including a containment cap having side walls and a top wall for enclosing the liquid fill valve or port, the air inlet and the liquid outlet; and further including a compressed gas tank dimensioned to fit within the containment cap.

22. The fluid container of claim 21, further including a battery, a fluid tight battery compartment having a battery compartment door, a solar panel for charging the battery, and a fluid pump engaging the interior of the housing, the fluid pump electrically engaged with the battery.

23. The fluid container of claim 21, wherein at least some of the walls of the housing engage one another in fluid sealing relation.

24. The fluid container of claim 21, further including a compressed gas source.

25. The fluid container of claim 21, wherein the containment cap has a vent.

26. The fluid container of claim 21, wherein the containment cap has an access door.

27. The fluid container of claim 26, wherein the containment cap includes a lock for the access door.

28. The fluid container of claim 21, further including a lifting bracket.

* * * * *